US010076214B2

(12) United States Patent
Goh Aow

(10) Patent No.: US 10,076,214 B2
(45) Date of Patent: Sep. 18, 2018

(54) TOILET TRAINING, BATHING AND TOILETING DEVICES FOR INFANTS, TODDLERS AND PRE-SCHOOLERS

(76) Inventor: Lee Lee Goh Aow, Surry Hills (AU)

( * ) Notice: Subject to any disclaimer, the term of this patent is extended or adjusted under 35 U.S.C. 154(b) by 1569 days.

(21) Appl. No.: 11/793,100

(22) PCT Filed: Dec. 20, 2005

(86) PCT No.: PCT/AU2005/001914

§ 371 (c)(1),
(2), (4) Date: Nov. 16, 2007

(87) PCT Pub. No.: WO2006/066316

PCT Pub. Date: Jun. 29, 2006

(65) Prior Publication Data

US 2008/0086804 A1 Apr. 17, 2008

(30) Foreign Application Priority Data

Dec. 20, 2004 (AU) ..... 2004907221

(51) Int. Cl.
*A47K 3/00* (2006.01)
*A47K 3/12* (2006.01)
(Continued)

(52) U.S. Cl.
CPC ..... *A47K 3/127* (2013.01); *A47K 11/06* (2013.01); *A47K 13/06* (2013.01)

(58) Field of Classification Search
CPC ..... A47K 3/127; A47K 11/04; A47K 11/06; A47K 13/06
(Continued)

(56) References Cited

U.S. PATENT DOCUMENTS 2,518,272 A 8/1950 Beckwith
5,311,617 A * 5/1994 Ammatelli et al. ..... 4/237
(Continued)

FOREIGN PATENT DOCUMENTS

DE 29814176 2/1999
JP 7-163487 6/1995
(Continued)

OTHER PUBLICATIONS

Japanese Notification of Reason for Rejection dated May 24, 2010, directed to Japanese Application No. 2007-547082; 5 pages.

*Primary Examiner* — Steven J Ganey
*Assistant Examiner* — Viet Le
(74) *Attorney, Agent, or Firm* — Design IP

(57) ABSTRACT

A toilet seat or receptacle, for use by newborns, infants, toddlers or preschoolers for assisting in their toilet training and toileting. The device includes a seat disposed about an opening, a head/backrest to which is attached a safety belt. It has one or more sound emitting devices to provide predetermined sounds used to induce or encourage the process of urination or defecation. It is configured for use with a toilet or potty or other toilet receptacle. The toilet seat has a left hand ramp portion configured to be disposed at a front left hand end of the toilet seat and configured for raising the left hand knee of the child towards the chest while sitting on the seat. The device also includes a right hand ramped configured to be disposed at a front right hand end of the toilet seat and configured for raising the right hand knee of the child towards the chest while sitting on the seat.

26 Claims, 13 Drawing Sheets

(51) Int. Cl.
*A47K 11/06* (2006.01)
*A47K 13/06* (2006.01)

(58) Field of Classification Search
USPC ..... 4/239, 667, 479, 483, 902; 297/423.11, 297/423.17, 423.19
See application file for complete search history.

(56) References Cited

U.S. PATENT DOCUMENTS

| | | | | | |
|---|---|---|---|---|---|
| 5,448,781 | A | | 9/1995 | Miller | |
| 5,685,029 | A | | 11/1997 | Gee | |
| 5,762,618 | A | * | 6/1998 | Yamanaka et al. | 601/148 |
| 5,797,148 | A | * | 8/1998 | Kivela | 4/235 |
| 5,893,178 | A | * | 4/1999 | Wosiek | 4/483 |
| 5,978,976 | A | * | 11/1999 | Chai | 4/483 |
| 6,038,711 | A | | 3/2000 | Clarke | |
| 6,052,840 | A | * | 4/2000 | West et al. | 4/300.3 |
| D425,607 | S | * | 5/2000 | Pham | D23/296 |
| 2003/0006639 | A1 | * | 1/2003 | Shimizu | 297/423.17 |
| 2004/0117901 | A1 | | 6/2004 | Armbruster et al. | |

FOREIGN PATENT DOCUMENTS

| | | |
|---|---|---|
| JP | 9-56643 | 3/1997 |
| JP | 2000-189348 | 7/2000 |
| WO | WO2002/017765 | 3/2002 |

* cited by examiner

PAGE 1 - POTTEE CHAIR AND ITS ACCESSORIES

PAGE 2 - ASSEMBLY OF TODDLER POTTEE CHAIR
Figure 2B1
Figure 2B2

Figure 2D1

PAGE 3 - ASSEMBLY OF INFANT POTTEE CHAIR
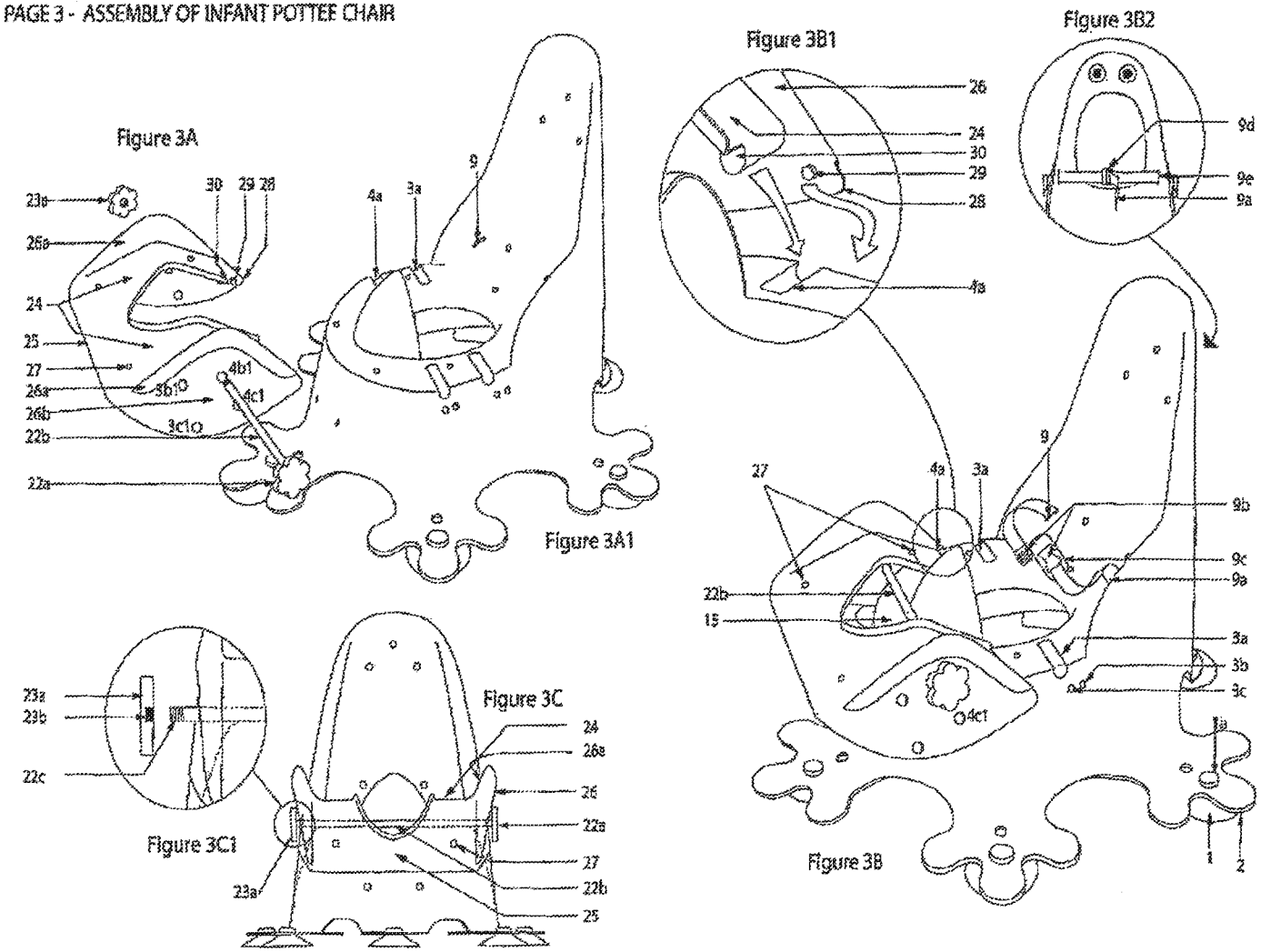

PAGE 4 - ADJUSTABLE LEG REST OF INFANT POTTEE CHAIR
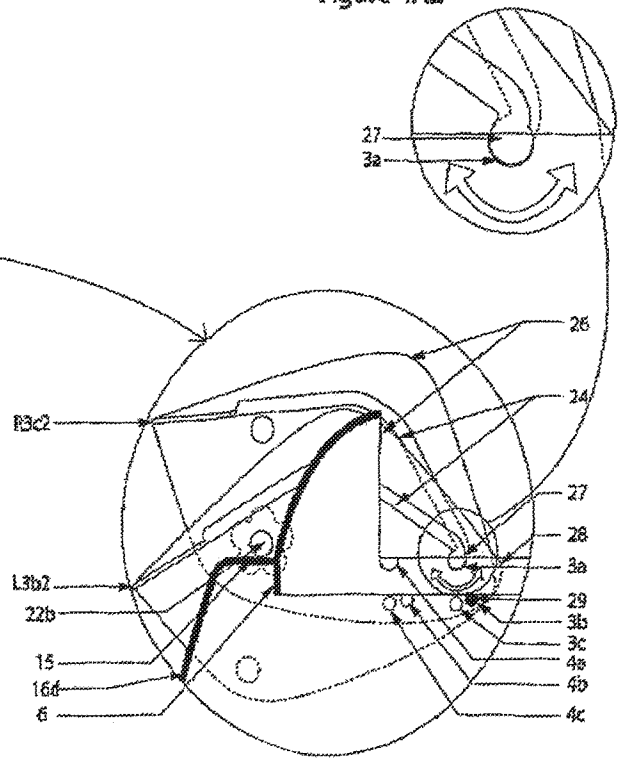
Figure 4A2
Figure 4A1
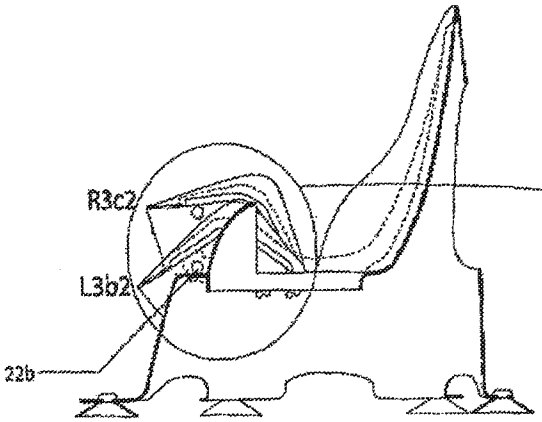
Figure 4A
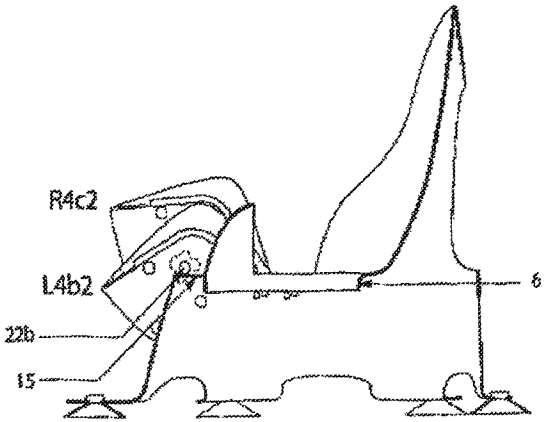
Figure 4B PAGE 5 - FULLY ASSEMBLED INFANT POTTEE CHAIR
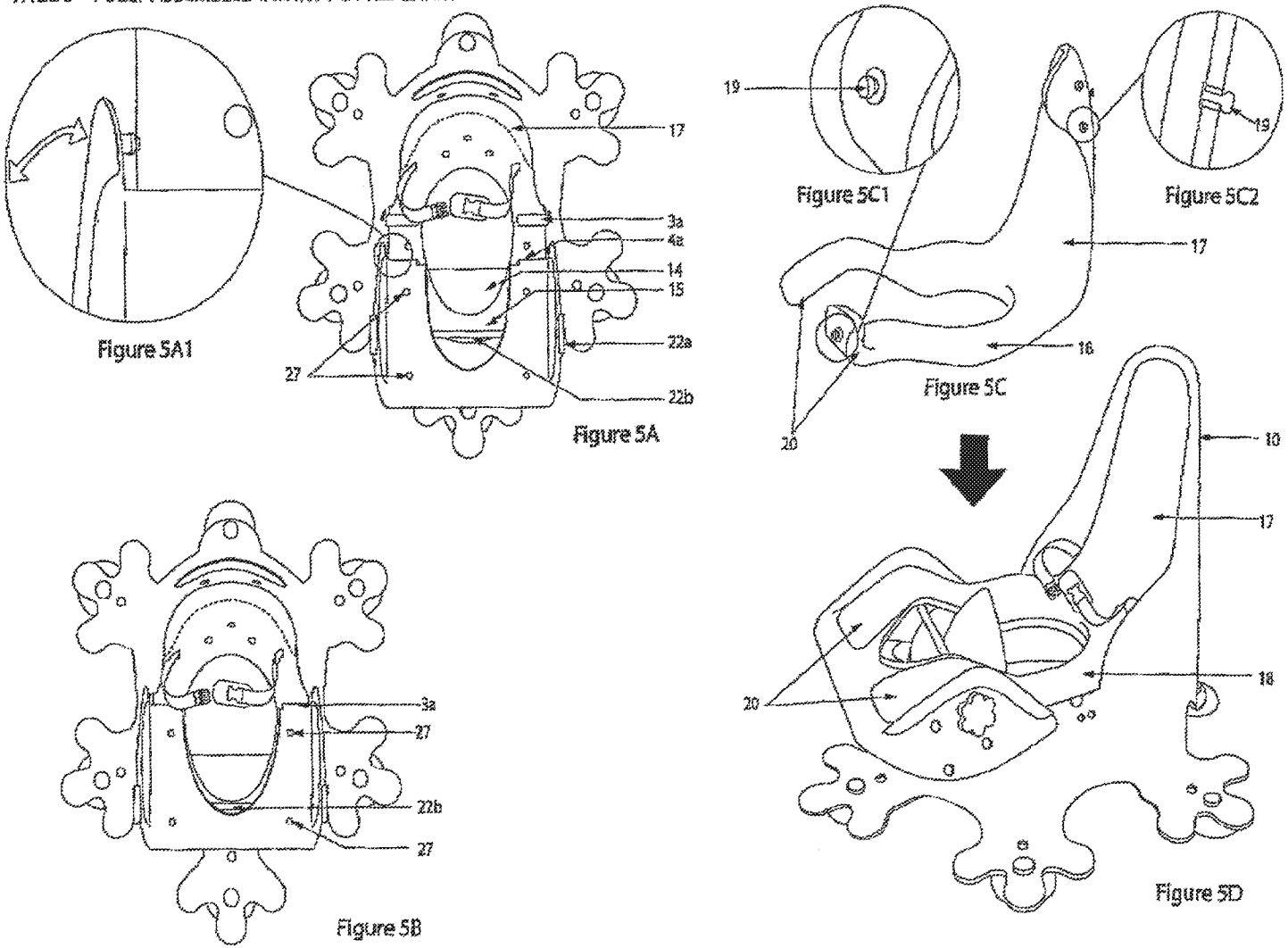

PAGE 6 - THE RELOCATABLE INFANT AND TODDLER POTTEE CHAIRS

PAGE 7-INFANT POTTEE/BATH CHAIR AND BATH TUB

PAGE 8- ILLUSTRATIONS - COMBINATION CHILD AND ADULT TOILET SEATS

Figure 8B2

PAGE 9 - INFANT POTTEE CHAIR WITH MOULDED LEG REST 6a,6b – elongate leg supports
7 – front wall
8 – rear wall
9a,9b – side walls
10 – lower edge (of walls)
11 – flat surface
12a,12b – thigh support regions
13a,13b – knee support regions
14a,14b – calf support regions
15 – front edge (of calf support regions)

Page 10 Illustrations

Version 3 of Device 1
The Toddler / Preschooler Potty Chair

TOILET TRAINING, BATHING AND TOILETING DEVICES FOR INFANTS, TODDLERS AND PRE-SCHOOLERS

PRIOR ART & PROBLEMS

Preliminary searches by the applicant, indicate that toileting devices designed for use by very young infants (0-1 year old) are not currently available in the market. Most toileting devices on sale including potty-chairs are designed for toddlers and preschoolers, who can already sit up or walk about.

Many parents are not even aware that they can toilet train their infants from birth. This is true in Western society, as many child care manuals recommend that toilet training can occur after the child is 1 to 2 years old. In most nurseries, preschools and kindergartens in Australia, the majority of infants and toddlers up to 2 year olds are wearing disposable nappies. Quite a number of three years olds and a few four years olds are still wearing nappies.

The use of nappies on young infants and toddlers prior to toilet training is the most expensive budget item for adult carers. The detergents used for washing non-disposable nappies may pose nappy rash and or environmental problems. The chore of having to wash and dry cloth nappies are considered too troublesome, by many busy parents today, Many parents resort to using huge quantities of disposable nappies and discarding these nappies containing urine and faecal matter with normal household refuse. Disposable nappies are also used in huge quantities by many child care facilities and other carers, and the disposal procedures used pose an ever increasing, potentially environmentally hazardous problem. Also, nappies soaked in urine cause discomfort, and many children suffer mild to severe nappy rash problems, requiring expensive medicated ointments, which may have other side effects.

The need for using and changing nappies was considerably reduced and avoided completely at a child's early age by the applicant's Chinese mother, as she toilet trained her own children and later, her grand-children from birth. Toilet training from birth seems to be not a commonly shared experience. Preliminary enquiries by the applicant Indicate that many other Chinese mothers also toilet trained their infants but they begin this training after the infant is about 6 months old or older, not at birth. This, though, is still at a much younger age than is generally accepted as an appropriate age for the commencement of toilet training in Western society which usually begins when the child is more than one or two years old.

The process used by the applicant's mother to toilet train infants from birth appears to be quite unique. Being a biologist, the applicant was surprised to observe her new born infant son, David urinating and defecating at her mother's signals to him. She wondered "How can he have control over his anal and urinary sphincter muscles at that young age?"

Yet her mother could induce David to release his urine and faeces at her command! She did this by resting his head and back close to her body, whilst she is sitting on a low stool. She positions him above a basin with water in it, by gripping his lower thigh with her hands and with his legs raised. She then encourages him to urinate or to defecate by making appropriate encouraging sounds. She is successful about 95% of the time, and David was clean and dry most of the time. He was toilet trained well before he turned one. Thus, the number of nappies used by David before he was toilet trained was considerably reduced.

The applicant would like to share her mother's technique with other child caters all over the world but a squatting position is difficult for many Western adults to obtain and/or maintain for any length of time and the sounds made to induce urination and defecation unfamiliar.

OBJECT OF TOILETING DEVICE

This device is a novel form of a child's portable toilet pot, or potty ("pottee"). It is designed to allow adult carers to use the applicant's mother's technique of toilet training infants without the need for the adult carer to sit on a low stool or to squat or to make appropriate sounds to induce urination or defecation.

The basic device is a portable, musical "pottee chair" to which is attached a detachable, adjustable leg rest to become "the infant pottee chair". The primary function of this device is for the toilet training of infants (0-10 months). Toilet training of the infant occurs very early, soon after birth. As the infant grows into a toddler (10-20 months), the infant pottee chair can be converted for the bigger child's use, by the removal of the adjustable leg rest to become "the toddler pottee chair".

The infant or toddler pottee chair, when used in conjunction with a receiving pot, is designed as a defecating and urinating device for infants and toddlers respectively. After its usage, the contents of the receiving pot, have to be emptied by the carer into the toilet.

The pottee chair is relocatable, as it can be moved about and attached firmly in any location with a flat clean surface, by its suction feet, Hence the carer has no need to squat and can place the pottee chair on a bench top, a sink or table top, when toilet training their infant.

The suction feet, also allows it to be attached firmly to an adult toilet seat. This enables the use of the device for defecation and urination by infants and toddlers directly into an adult toilet, without the need for emptying, a used receiving pot.

The pottee chair will be specially equipped with 2 copyrighted music discs, one playing sounds/music that encourages the defecation process and the other, the urination process The "infant pottee chair" is a novel device because it can be used for toilet training infants (babies) from birth. It is designed to enable the infant to assume a position with legs raised which is a more effective position for the release of urine and/or faeces by the infant.

The routine of encouraging the process of urination and defecation by the baby before its morning bath, lends itself to the convenience of bathing the infant after it has been strapped into the pottee chair. The infant pottee chair now serves a second important function as a suitable and efficient bathing device for infants who are unable to sit up on their own.

The infant who has outgrown the infant pottee chair with the detachable, adjustable leg rest can then directly use the pottee chair without the leg rest, as a "grown up" toddler. The toilet training device is designed to be viewed as a familiar device used regularly on a daily basis by the infant. By using the toilet training device from an early age as an infant, the toddler, is inducted into seeing toileting as a routine, relieving, safe and good experience. The toddler will be encouraged by the specially designed pottee chair to urinate and defecate independently from an early age.

The pottee chair has 6 feet, each with its own suction disc. This gives the pottee chair a lot of grip and stability and when placed in a bathroom on tiles, it can be used by a toddler, without danger of the pottee chair being bowled over and spilling its contents when the toddler sits on or gets up from it The suction feet also provide, excellent grip for attaching the pottee chair to the seat of an adult toilet. It allows the carer, armed with the device, to toilet train very young infants on an adult toilet anywhere in the world. It allows toddlers to defecate and urinate safely and directly into an adult toilet, anywhere in the world.

Early toilet training, reduces/eliminates the need for carers to clean up messy, smelly bottoms, They are not faced with the environmentally hazardous problem of having to dispose of soiled nappies that may be made with non-biodegradable plastic. It saves the parents the cost of their most expensive budget item, nappies! It reduces/eliminates mild to severe nappy rash problems and the need to use expensive medicated creams that may have other side effects. It eliminates the discomfort of the child's bottoms being soaked in urine or smeared with faeces and it encourages the child's early independence.

If infants are toilet trained from birth and the toddler is toilet trained by one, it will reduce the world's ever increasing, potentially hazardous, enormous pollution problems caused by nappy usage by at least 50%. The applicant hopes to make an educational documentary to accompany the sale of this product if it is manufactured.

BRIEF DESCRIPTION OF EACH FIGURE

Page 1 Illustrations Pottee Chair and its Accessories

Page 2 Illustrations Assembly of the Toddler Pottee Chair

Figures 2A, 2B, 2C, 2D, 2E:
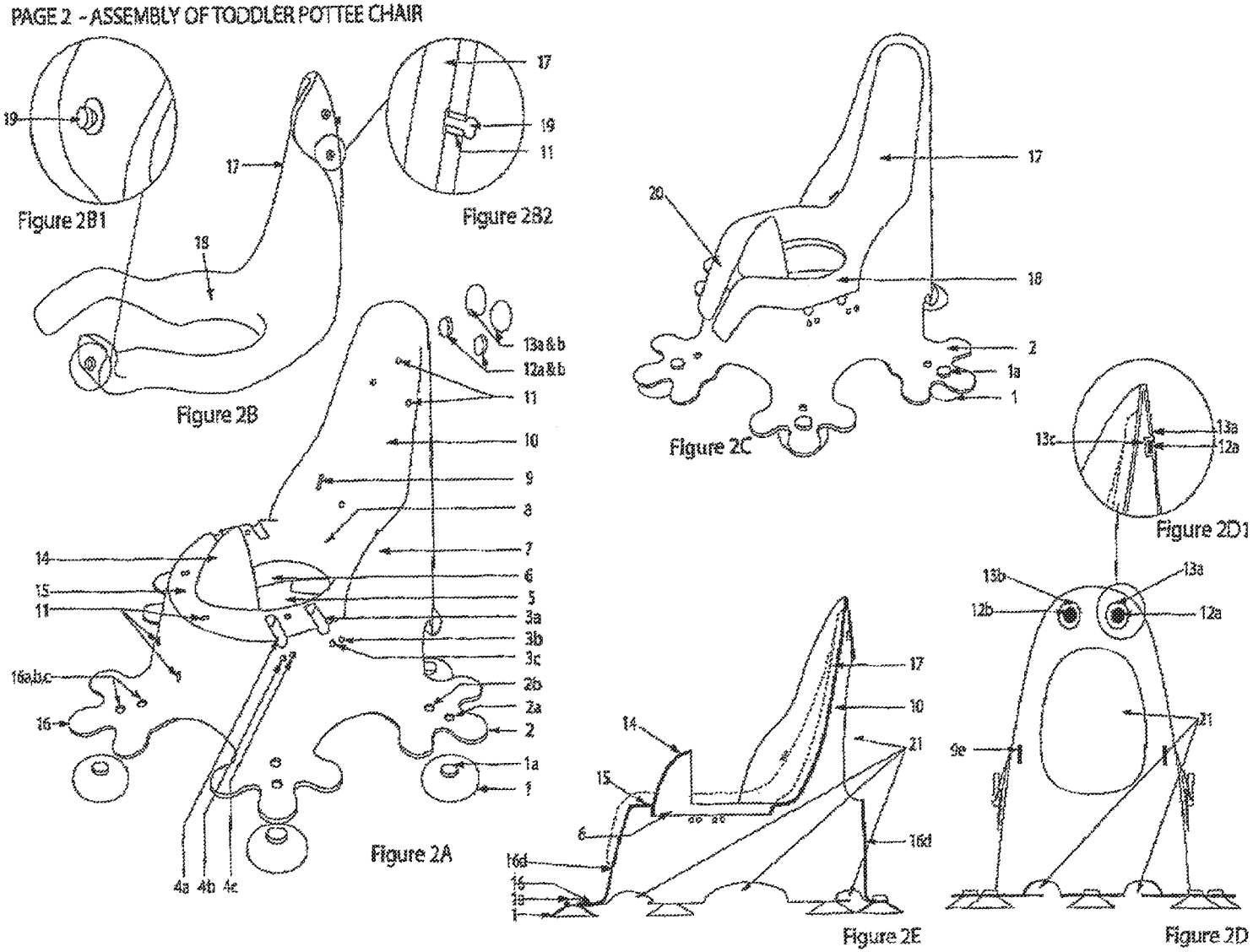

FIG. 2A is a perspective view of the basic toileting device, a pottee chair, for toilet training infants and toddlers. It consists of an injection moulded plastic chair made from polypropylene, with a seat 8 to hold the infant's/toddler's bottom. In the middle of the seat is an oval shaped opening S to allow for the passage of urine and faeces from the infant's/toddler's anus, penis or vagina. The anterior end of the hole is covered by a dome shaped wee splashguard 14 which is designed to prevent the spillage of urine especially when the device is used by a male infant or toddler.

The pottee chair, has a back rest 10 which is especially important for supporting a delicate infant's head and back. The back rest 10 and seat 8 have moulded-in holes 11. The holes are designed to receive the rubber studs 19 of FIGS. 2B1 & 2B2 from a waterproof, self sealing horseshoe shaped, polyurethane soft foam cushion 17 of FIG. 2B. The cushion when attached to the back rest 10 and seat 8 of the pottee chair will act as a padding device providing protection and making the pottee chair warm, soft and comfortable for the infant/toddler. The back rest is extended into the side guards 7, to hold the infant's/toddler's buttocks in place and to prevent the infant from failing sideways. Slot 9, one on each side, suitable for the passage of the "infant seat belts" are located in the lower back portion of the back rest. Details of the seat belts are described in page 3.

The pottee chair sits on six attractively designed pottee feet for example 2, 16 all with holes 2 *a,b* & 16 *a,b* moulded into them. The holes are designed to receive the head of the soft plasticised suction cap 1. The suction cap head 1*a* can be placed through any hole. When all 6 suction caps are in place, they will hold the pottee chair firmly to any flat, clean floor surface or bench/table tops made from materials such as tiles, timber, cork, parquet, vinyl, metal, glass, laminates or plastic. The 6 pottee feet, each with their own suction disc, gives the pottee chair a lot of grip and stability. For example, when placed in a bathroom on tiles, it can be used by a toddler without danger of the pottee being bowled over when the toddler sits on or gets up from it. This is important to prevent any spillages from the receiving pot when it is in use.

All the pottee feet, have two holes to receive the suction cap heads, Adult toilets can vary slightly, both in length and width. The various possible positions of attachment of the 6 suction pads, to the different locations of the pottee feet holes, gives the pottee chair the flexibility to be accommodated, on the different sized toilet seats. The inner holes are used for accommodation of the pottee chair, to smaller toilet seats and the outer holes, to larger ones.

The regions of the wall above the pottee feet are thickened 16*d* to strengthen it (see FIG. 2E). The plastic wall is thickened just sufficiently to support the weight of the heaviest toddler without the feet splaying. The pottee feet may be differently coloured from the seat to make it more attractive to the infant/toddler.

Located on each side of the pottee seat are two moulded-in cylindrical recesses 3*a* and 4*a*. 3*i* is placed closer to the sitting infant and 4*a*, a little further away. They are designed to receive the cylindrical moulded hinge 30 (its function will be described in pages 3 & 4) of the infant leg rest 1B when it is attached to the pottee chair. The pair of holes 3*b* & 3*c*, 4*b* & 4*c*, below each recess are designed to receive the cylindrical protrusions "pegs" of the infant leg rest 1B (their roles will be provided in pages 3 & 4 as well).

FIG. 2 C shows the pottee chair assembled with the self sealing horseshoe shaped polyurethane soft foam cushion and ready to be used by a toddler. The loose ends of the horseshoe shaped cushion allows it to be draped around the pottee hole, attached by rubber studs 19 to the holes 11 as shown in detail in FIG. 2B(2) of the pottee seat. It covers the recesses 3*a* & 4*a* at point 18, so that the presence of the indentation, will not be felt by and discomfort the baby. Its ends are held in place by rubber studs 19 fitting into holes 11 on the anterior walls of the pottee chair (see FIG. 1A for holes 11). The cushion provides protection and makes the pottee chair warm, soft, comfortable and inviting for the toddler to sit on. The cushion can be removed for washing when necessary.

FIG. 2 D is the posterior perspective view of the pottee chair. Inserted into the pair of recesses 13*c* at the top most position of the back rest wall are a pair of sound/music disc 12*a* & 12*b*. This position will ensure that the music disc are not immersed in water when the pottee chair is used as a bath. (See page 8 for more details of the chair in a bath tub). Once the music discs are in place, they are covered over by a flexible transparent stick on plastic Cover 13 *a* and 13 *b* respectively. The transparent cover allow the carers to identify the disc and start the music by just a push of the finger on it. Th cover 13*a* and 13*b* ensure that the music discs 12*a* and 12*b* are protected from potential splashes of water, when the chair is used as a bath chair. The music discs are held in place by the pair of recesses 13 *c* and the plastic cover 13 *a* and 13*b*. The music disc are thus removable and replaceable, if they should wear out by the time the carer wants to use it for a second baby, a few years down the track.

The music disc 12*a* (labelled "Wee") will carry uniquely created copyrighted, sounds/music that will encourage the infant to urinate and 12 *b* (labelled "Poo") will carry sounds/music that will encourage the infant to defecate. Once the infant is fully trained, their use will no longer be necessary. The seat belts from slot 9 are passed through Slot 9*d*, and its length is adjusted at the back of the chair with a plastic adjustable clip 9*e*. Details of the seat belts are described in page 3.

As the pottee chair is made of strong polypropylene plastic, it is important to minimise the quantities of plastic required to make it. The curved cutaways 21 achieves this without the potty losing too much strength, as well as contribute to the pottee's flexibility and aesthetics Cutaways also shown in FIG. 2E.

FIG. 2E is a longitudinal sectional view of the pottee chair with the soft foam cushion in place. The thickness of the soft foam cushion is indicated in 17, This view also reveals the dome shape roof of the wee splashguard 14 and the downward slope and thickness of the rim/lip 6 of the pottee hole. (see page 6 for more details of its role), It also illustrates the thickness of pottee wall 16*d* above the pottee feet.

Page 3 Illustrations Assembly of the Infant Pottee Chair

FIG. 3A is a perspective view of the detachable, adjustable infant leg rest. It consists of two curved molded plastic leg support platform 24, designed to fit the lower half of the infant's/toddler's thighs and shins which are held together by a central joining plate 25. The leg support platforms 24 have holes 27 suitable for receiving the rubber studs of the soft foam cushion (More details provided in page 5). The outer edge of the leg support platforms 24 are attached to two outer walls, the side plates 26. The leg support platform is curved upwards and outwards and then downwards over the side plate 26 (shown more clearly in FIG. 30) to form the leg wing 26*a*. This provides a bigger surface area to accommodate the varying sized thighs and shins of the infants and ensuring that they are supported comfortably and the infant's legs will not fall out sideways. 2 sets of a pair of holes 4*b*1 & 4*c*1 and 3*b*1 & 3*c*1 are punched on the side plate 26 below the leg wing 26*a*. They are designed to receive the support rod 22 *b*. A detailed description of their respective functions will be given in FIG. 3C below.

FIG. 3B1 shows the details of the attachment structures on the side plates 26

The leg support platforms 24, terminate in a cylindrical moulded hinge 30, towards the posterior end of the infant leg rest. At this end also, the leg wings 26 terminate at the leg wing tip 28 which, can be flexed outwards slightly at this point. A cylindrical protrusion. the "locating peg" 29 sits in between the hinge 30 and the leg wing tip 28.

FIGS. 3B and 3B1 illustrates the process of locking the leg rest in position on the pottee chair By flexing the two side plate/leg wings outwards, and then inwards at tip 28, the cylindrical moulded hinge 30 can be clipped onto the cylindrical recess 3*a* or 4*a* on the pottee seat, using a slight interference fit. This interference fit hinge joint secures the infant leg rest to the pottee chair, just enough to stop any unwanted disassembly but also allows the leg to be removed when desired. Further support to prevent disassembly is provided by the locating peg 29 which is designed to fit into holes 3*b*, 3*c* or 4*b*, 4*c*.

The interference fit joint allows the leg rest to be rotated to two positions depending on the point of attachment of the locating peg 29. This is illustrated more clearly in page 4 in diagrams 4A1 and 4A2.

FIG. 3C illustrates the frontal perspective view of the infant pottee chair and FIG. 3C1 provide the details of the screw on attachment structure of the flower nut to the tip of the support rod 22*b*

The weight of the infant's legs will exert a downward pressure on the anterior unsupported end of the leg rest. This is overcome by the use of a strong support rod 22*b*.

The four holes 3*b*1, 3*c*1 and 4*b*1, 4*c*1 of the side plates are carefully positioned such that when the support rod 22*b* is slotted through the appropriate hole, the leg rest will be secured and supported in the correct position on platform 15

FIG. 3A illustrates how, the support rod 22 *b* which terminates on one end with the flower nut 22*a* is slotted through the hole in the 4*b*1 position in the side plate of the leg rest. A flower nut 23*a* is then screwed at 23*b* onto the screw threads at the end 22*c* of the support rod to secure it. This position is selected when the hinge 30 is secured in the cylindrical recess at the 4*a* position and the locating peg 29 is in the 4*b* position. The support rod rest on the platform 15 at the front end of the pottee seat (see FIG. 3B), supporting the leg rest from the downward force evenly. When the peg 29 is secured in the 4*c* position on the pottee chair, the support rod has to be inserted in the corresponding 4*c*1 position on the leg rest, so that it will still be supported by platform 15. See FIG. 3B. This process is illustrated in FIG. 4B in page 4 and 5A in page 5 as well.

When the hinge 30 is moved and secured in the 3*a* position for a smaller infant with shorter limbs, and with the locating peg 29 in the 3*b* position on the pottee chair, the support rod will be inserted in the 3*b*1 position on the leg rest. If the peg is inserted at the 3*c* position, then the support rod should be moved to the corresponding 3*c*1 position on the leg rest. In this case the support rod will be resting on platform 15 and close to the base of the wee splashguard 14 (shown more clearly in FIGS. 4A and 4A1 in page 4)

FIG. 3B2 is the back view showing the positioning of the seat belt and music discs.

Finally to secure a young infant safely, conveniently and securely to the chair, a detachable, waterproof, flexible plastic seat belt 9*a* with a plastic seat belt clip 9*b* is threaded through the slots 9 and 9*e*. The length of the strap is adjusted at the back of the chair with a plastic adjustable clip 9*d*, to accommodate different sized infants. A waterproof, soft protective plasticised foam pad 9*c* is provided to prevent any skin pinching when the seat belt clips 9*b* are clipped on. The seat belt is removed when it is no longer required for older infants and toddlers.

Page 4 Illustrations the Adjustable Leg Rest of the Infant Pottee Chair

FIG. 4A is a sectional view of the pottee chair with the adjustable leg rest attached in the 3*a* position.

FIG. 4A1 is a blowup of the sectional view, showing the adjustable leg rest being rotated to two possible positions by the positioning of the locating peg 29.

FIG. 4A2 is a blowup of the moulded hinge 30 in its recess 3*a* and FIG. 4B is a sectional view of the pottee chair with the adjustable leg rest attached in the 4*a* position.

FIG. 4A1 provide more detailed Illustrations of the mechanism used to raise or lower the leg rest (which has also been partially described in page 3 above). By flexing the two side plate/leg wings outwards, and then inwards at tip 28, the cylindrical moulded in hinge 30 as shown in blowup in FIG. 4A2 can be clipped onto the cylindrical recess 3*a* or 4*a* on the pottee seat, using a slight interference fit. This interference fit hinge joint secures the infant leg rest to the pottee chair just enough to stop any unwanted disassembly but also allows the leg to be removed when desired.

Further support to prevent disassembly is provided by the locating peg 29 which is designed to fit into holes 3*b*, 3*c* or 4*b*, 4*c*. (shown fitted into hole 3*b* in FIG. 4A1). The interference fit joint allows the leg rest to be rotated to two positions depending on the point of attachment of the locating peg 29.

If the locating peg 29 is attached to the 3*b* or 4*b* hole position, the infant leg rest is in a lowered (L) position, illustrated more clearly here as L3*b*2 and L4*b*2. If the peg is attached to the 3*c* or 4*c* hole position, the hinge will rotate, and the infant leg rest will be in the raised (R) position, illustrated more clearly here as R3*c*2 and R4*c*2. These positions are selected, depending on the angle that is most suitable to encourage the defecation/urination process as well as comfortable for the legs of the respective infants, by their carers. (see FIGS. 4A and 4B).

In this embodiment, the opening 6 lies on a first plane (in other words, the two-dimensional area that corresponds with the superior portion of the opening is located within the first plane). The leg rest attaches to the body (via cylindrical recesses 3*a*, 4*a*) and extends approximately from the opening 6 towards a front side of the body, the leg rest comprising a first pair of surfaces and a second pair of surfaces, each of the surfaces of the first pair of surfaces being joined to a respective one of the surfaces of the second pair of surfaces by a bend. Each of the surfaces of the first pair of surfaces lies in a plane that extends at a positive angle with respect to the first plane as measured from where the leg rest is attached to the body to the respective bend. Each of the surfaces of the second pair of surfaces lies in a plane that extends at a negative angle with respect to the first plane as measured from the respective bend to a distal end of the respective surface.

When the leg rest is attached at the 3*a* & 3*b* or 3*c* positions, it is suitable for use by smaller infants with shorter legs. (see FIG. 4A) When the infant grows taller and has longer legs, the leg rest can be removed and reattached at the 4*a* & 4*b* or 4*c* positions (see FIG. 4B). By the time the infant is 8 months or more (depending on each child's growth), the leg rest may no longer be necessary and can be removed altogether.

Note that the support rod 22*b* will be placed such that it always rest on platform 15 and is supported by it See FIGS. 4A, 4A1 and 4B in page 4 and FIGS. 5A and 5B in page 5 illustrates this more clearly.

Page 5 Illustrations the Fully Assembled Infant Pottee Chair

FIG. 5A illustrates the TOP VIEW of the infant Pottee chair with attached leg rest in the 4*a* position FIG. 5B shows the attached leg rest in the 3*a* position.

FIG. 5A is a blowup of the top view of attachment device (the hinge 30) on the side plate of the leg rest FIG. 5B shows the leg rest attached at the 3*a* position. The support rod 22*b* is passed through either the 3*b*1 or 3*c*1 hole on the side plate 26, (described in page 3) and it lies supported on the pottee seat platform 15, adjacent to the base of the dome shaped wee splashguard 14.

FIG. 5A shows the leg rest attached in the 4*a* position. The supporting rod's position is changed and it is passed through holes 4*b*1 or 4*b*2 on the side plate 26 (as described in page 3) so that it still gets maximum support from platform 15.

FIGS. 5C, 5C1 and 5C2 show the same soft foam cushion as described in FIGS. 2B, 2B1 and 2B2 in page two illustrations and FIG. 5D illustrates the fully assembled Infant Pottee chair.

The assembled infant potty chair with its leg rest is made more comfortable by lining it with the horse shoe shaped polyurethane soft foam cushion as shown in FIG. 5C. The cushion is attached by rubber studs 19 to the holes 11 on the back rest and seat of the pottee chair. Its middle section18 is draped over the pottee seat, covering the recesses 3*a* and 4*a*, so that the presence of the indentation, will not be felt by and discomfort the baby. The free ends 20 are then draped over the leg support platform 24 and are held in place by rubber studs 19 attached to the holes 27 (as shown in FIGS. 5A and 5B) on the infant leg rest. The cushion acts as a waterproof padding, providing protection and making the assembled pottee chair warm, soft and very comfortable for the infant to lie in. The cushion can be removed for washing when necessary.

Page 6 Illustrations the Relocatable, Infant and Toddler Pottee Chairs

Figure 6A:
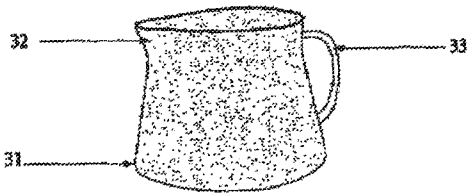

FIG. 6A shows the side perspective view of the receiving pot. It has a deep broad base 31 and is constructed of a non-porous, non stick surface plastic material which makes it easy to clean. The receiving pot has a spoon shaped spout 32 for the disposal of its contents into the toilets, thus reducing spillages and splashes. It has a strong, well shaped rounded handle 33 suitable for the finger and hand grip of both male and female carers.

Figure 6C:
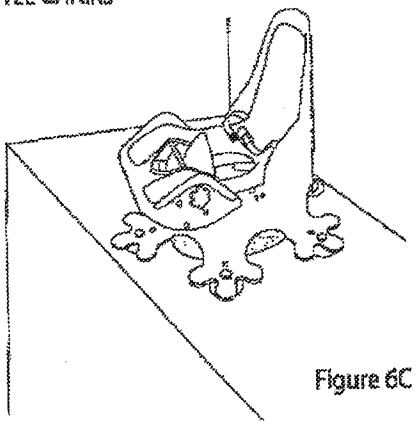
Figure 6E:
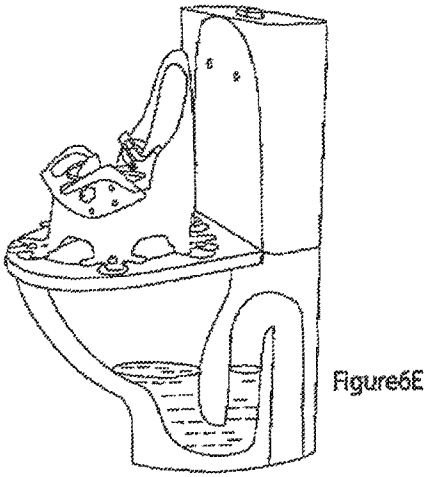
Figure 6B:
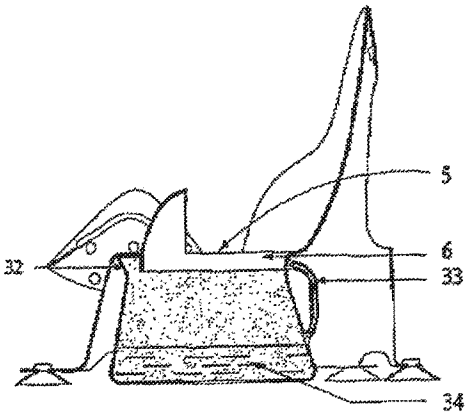

FIG. 6B illustrates how the mouth of the receiving pot is placed directly below and outside the rim 6 of the pottee hole 5 to receive the products of the urination and defecation process. Its height is such that its rim sits just below the bottom of the pottee seat, thus providing the seat and pottee chair with further support when a heavy toddler sits on it. When in use, the receiving pot is partially filled with about 5 to 6 cm of water 34 before it is placed in position. The water acts as a concealing agent for the faeces as it is deposited, thus reducing its smell as well as preventing it from sticking on the potty wall.

The fully assembled toddler or infant pottee chair can be used in any location as an instrument for urination and defecation as long as it is used in conjunction with a portable receiving pot.

FIG. 6C illustrates the placement of the infant pottee chair with the leg rest attached, with the receiving pot in place, on a bench top by carers, for use with an infant.

Figure 6D:
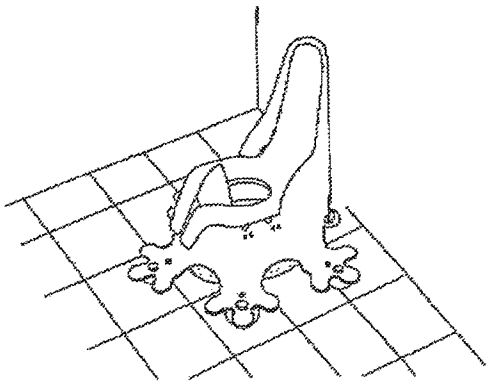

FIG. 6D illustrates the placement of the toddler pottee chair with the receiving pot in place, in the bathroom, for use by toddlers independently or with adult supervision.

FIG. 6E illustrates the placement of the infant pottee chair, without the use of the receiving pot, for direct urination and defecation by the infant into the adult toilet, thus eliminating the need to empty a used receiving pot. The infant can be strapped into the chair only after it has been carefully attached to the adult toilet seat or it can be strapped first into the chair, and then the chair, with the infant in it, is attached by its suction feet onto the toilet seat. This will depend on how active the infant is and what is more convenient for the carer.

Figure 6F:
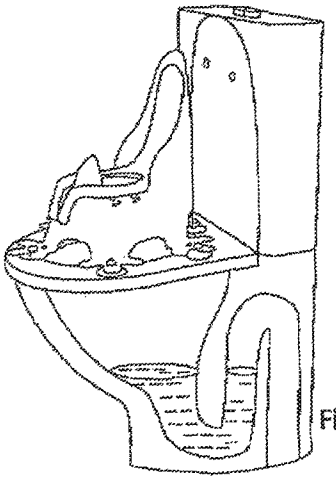

FIG. 6F illustrates the placement of the toddler pottee chair (without the use of the receiving pot) for direct urination and defecation by a toddler into the adult toilet, thus eliminating the need to empty a used receiving pot. The toddler is placed on the chair after the pottee's suction feet have been carefully attached to the adult seat by the carer.

NOTE THAT THOUGH THE SIX SUCTION CAPS OF THE POTTEE CHAIR PROVIDE A GOOD GRIP ON THE ADULT TOILET SEAT, NO INFANTS OR TODDLERS SHOULD EVER BE LEFT UNATTENDED IN THIS POSITION FOR EVEN ONE SECOND, BY AN ADULT.

THEREFORE THE CHAIR WILL CARRY THE MESSAGE:

NO INFANTS/TODDLERS SHOULD BE LEFT UNATTENDED FOR EVEN ONE SECOND, IN A POTTY CHAIR WHEN IT IS ATTACHED TO A TOILET SEAT OR IN ANY OTHER ABOVE GROUND LOCATION.

Page 7 Illustrations the Infant Pottee/Bath Chair and Bath Tub

The routine of encouraging the process of urination and defecation by the baby before its morning bath (ends itself to the convenience of bathing the infant after having already been strapped into the pottee chair. The pottee chair now serves a second function as an excellent baby bathing device for infants who are unable to sit up on their own. Unlike other conventional bath chairs designed for infants, when the infant is strapped in the pottee chair, the pottee's hole 5 (shown in page 2) makes it easier for the carer's to clean the infant's private parts and bottom.

When in use as a bathing device, the "infant pottee/bath chair" can be placed in any existing bath, in a large sink or in any suitable sized plastic bath tub. When bathing an infant, a standing position is more comfortable than a squatting position for the adult carer and therefore placement of the chair in a large sink or in a bathtub placed on a bench top will be more comfortable.

Figure 7A:
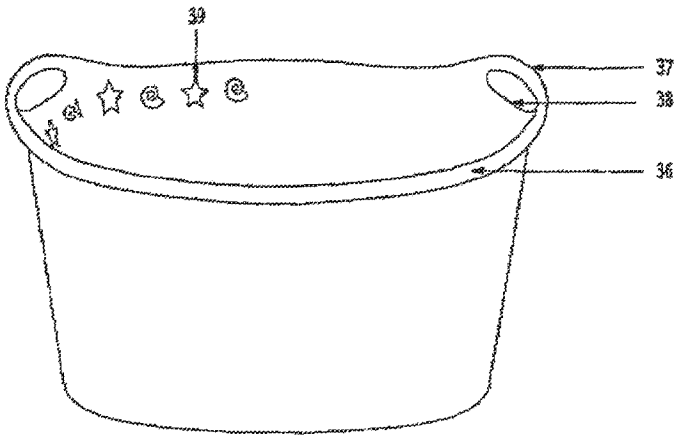
Figure 7B:
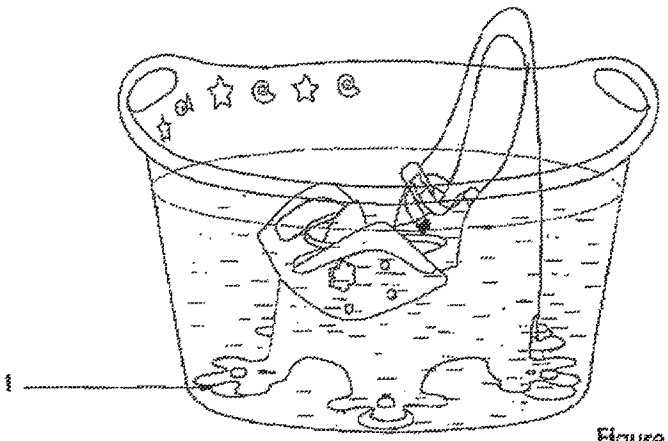

An optional plastic bathtub as shown in FIG. 7A will be designed such that the infant pottee chair fits snugly in it, as shown in FIG. 78. Its height is such that the top 10 cm of the pottee/bath chair protrudes from it. This ensures that the 2 music discs 12*a* and 12*b* are never immersed in water and their stick on plastic cover 13*a* and 13*b* will protect the discs from any potential splashes of water. Warm water in the bathtub is filled only to the level of the shoulders of the young infant that is strapped to the chair.

The rim 36 of the bathtub will be extended into two vertical very strong, comfortably rounded handles 37 with finger grip spaces 38 large enough for the fingers of both male and female carers. This enables the bath to be lifted easily for the convenient disposal of its watery content when the infant has finished bathing in it.

The internal space 39 just below the rim of the bathtub can be designed with uniquely designed, attractively coloured plastic moulded images of a few sea creatures. This will make the bathtub attractive and familiar to the infant and the images will be designed such that they provide a topic of interest for conversation by the carer with the infant. Its inclusion in the design of the bathtub will be dependent on the overall cost of production.

During storage, the bath tub could serve a second function of containing the pottee chair and all its accessories.

THE BATH WILL CARRY THE MESSAGE THAT:

NO INFANT SHOULD BE LEFT UNATTENDED EVEN FOR ONE SECOND IN A BATH.

Page 8 Illustrations—Combination Child and Adult Toilet Seats

The toileting needs of the toddler who has outgrown the pottee chair, can be met by a child sized toilet seat designed for the grown up toddler—the preschooler (2-5 year olds).

Figures 8A, 8B, 8C, 8D:
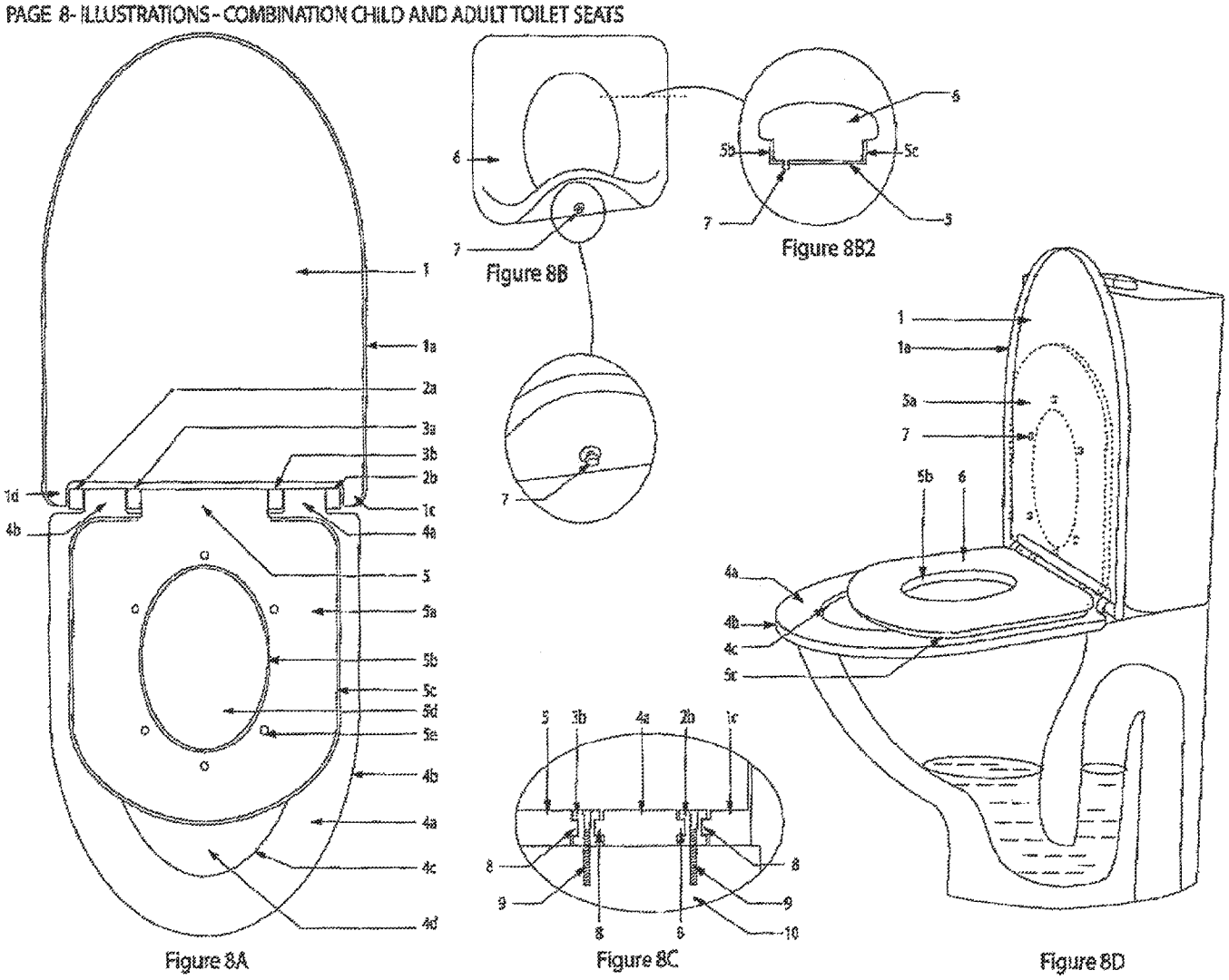

FIG. 8A, shows the top frontal perspective view, of a child sized plastic toilet seat 5*a* sitting on an adult plastic toilet seat 4*a* and with the toilet seat cover 1 in a lifted position. The adult toilet seat 5*a* sits on and is supported by the toilet bowl rim. FIG. 8C is a sectional view showing how the toilet seats and cover are attached to the hinges by cylindrical shaped protrusions "pegs" emerging from their attachment parts. The hinges 2*a*. 3*a* and 2*b*, 3*b* are bolted onto the toilet bowl by a screw on mechanism. The two pegs from 4*a* are inserted into the hinge 2*a* and 3*a* respectively while the pegs from 4*b* are inserted into the hinge 2*b* and 3*b*. These hinges allow the seat to be rotated on the joint and it can be lifted up or down.

The child toilet seat 5*a* is attached to the toilet bowl by attachment part 5, using a similar mechanism of the two pegs emerging from it being inserted Into the hinges 2*a* and 3*a*. Thus it is sitting on and supported by the adult seat and it can be lifted up, when it is not in use and down, when it is. The toilet bowl cover is attached by a single peg emerging from 1*c* being Inserted into hinge 2*b* and a single peg from 1*d* being inserted into the hinge 2*a*, This ensures that the cover 1 folds over both toilet seats when it is down and it can be lifted up and rested against the cistern when the toilet is in use as illustrated here in FIG. 8D. Thus we have what is a combination child and adult toilet seat structure which will cater for both adults and children.

The child seat is designed such that its central seat hole 5*d* is much smaller that the adult seat hole 4*d* and it is suitable for the little bottoms of preschoolers from 2 to 4/5 years of age. The flat broad seat 5*a* has upturned rounded rims 5*b* and 5*c* shown also in cross section in FIG. 8B2. It has a number of small moulded in holes 5*e* nearer the periphery of the central seat hole.

To make the child toilet seat more comfortable, a self sealing polyurethane soft foam cushioned 6 as illustrated in FIG. 8B is designed to sit on the child seat. The soft foam cushion 6 is attached to the seat boles 5*e* by rubber studs 7 as illustrated in blowup FIG. 8B1 and in cross section FIG. 8B2, It is held in place by the upturned rims 5*b* and 5*c* The cushion 6 makes the seat soft, warm and comfortable for the preschooler. The waterproof cushion can be removed for washing if necessary and can be replaced if it is damaged after prolonged use (after a few years).

FIG. 8D shows the side perspective of the child toilet seat being lifted up and resting against the toilet seat cover which is in turn resting on the cistern, as well as it being put down with its cushion in place and sitting on an adult toilet seat.

In this illustration, the child seat is just sitting on a plastic adult seat. However, a soft foam cushion similar in design to the child seat, could also be made for the adult seat if desired. This will make the seats very comfortable for both child and adult.

CONCLUSION

The presence of a child toilet seat in one bathroom in every home or in a public facility, will make it much easier for child carers to cater to the toileting needs of their toilet trained preschoolers. Adult seats are not suitable for preschoolers to sit on. The inventor has seen small children trying to do their toileting in public toilets, by sitting on the front edge of an adult toilet seat, clinging to the rim with their hands and scared to death of falling into the big hole of the adult toilet.

Finally, it can be said that infants, toddlers and preschoolers require their toileting needs to be met, the same way as adults. If they can speak, infants would say they would rather not be swathed in urine soaked nappies that can cause them nappy rash. They would rather not, be discomforted, by their bottoms being caked in faeces and their noses overwhelmed by the stench, for prolonged periods.

It is the inventor's hope that more homes will eventually have a bathroom, which is equipped with facilities and devices that will provide for the toileting needs of infants, toddler and preschoolers, not just for adults.

It is hoped that with the help of the above devices and the effective promotion of the toilet training strategies used by the inventor's mother, the culture of toilet training infants from birth or at an early age, will be adopted by more parents and child carers. If one in two or three new mothers and child care facilities in countries such as America, Canada, England, Europe, Japan, Asia and Australia toilet train their infants from an early age, the world's usage of nappies will be reduced by considerably more than 50%.

Figure 9B:
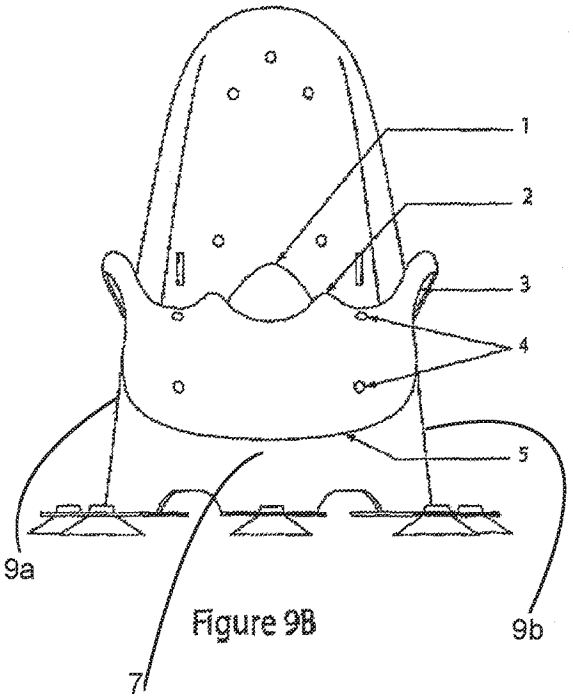
Figure 9A:
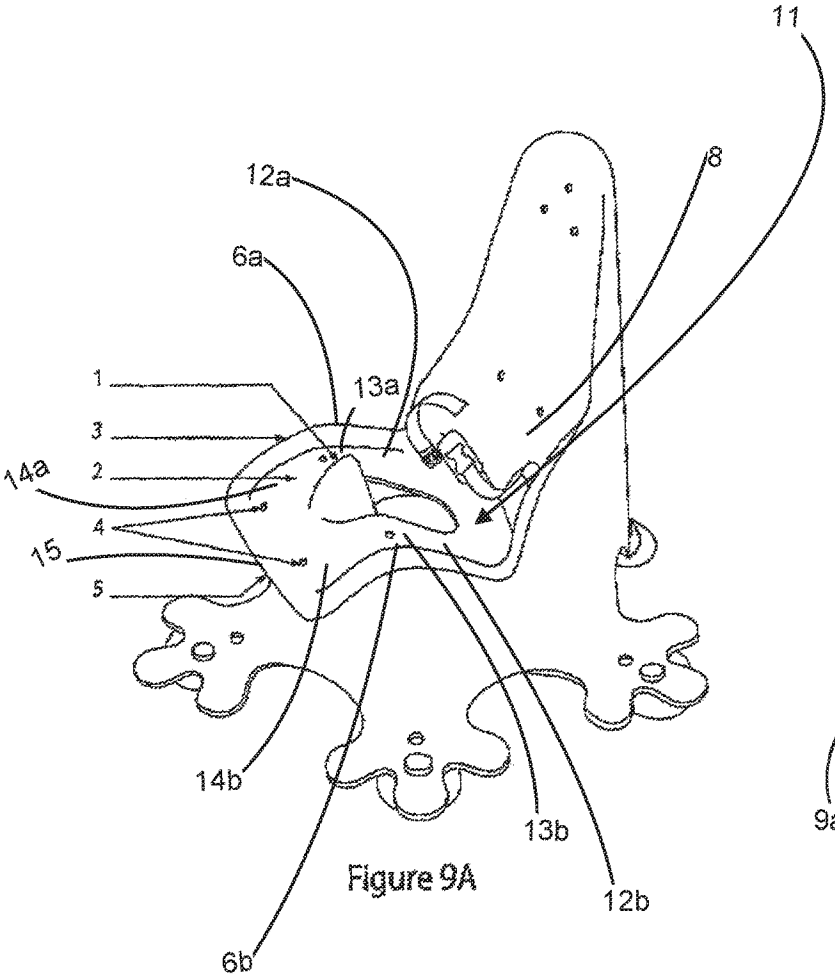

Page 9 Illustrations—Device 1 Version 3 of the Portable Infant Pottee Chair with Molded in Leg Rest The infant pottee chair with the detachable and adjustable raised leg rest as in FIGS. 3B and 3C is replaced by a raised leg rest that is molded into the pottee chair as shown in FIG. 9A, hence eliminating the need for the parts required to make the leg rest adjustable but retaining the raised leg platform. The Infant pottee chair still has the wee splashguard labeled 9 A1, the leg support platform labelled 9A2, the leg wing labelled 9A 3, the holes 9A4 designed to receive the studs of the self sealing horseshoe shaped polyurethane soft foam cushion similar to FIG. 10C in the provisional drawings and the leg support platform are held together by the joining plate labelled 9A5.

The pottee chair with the molded in leg rest will essentially have all the other features of Version 2 of the infant pottee chair as shown in FIGS. 3B & 3C such as the back and head rest, side guards, music discs, the safety belt, the potty hole, the potty feet and suction disc, the wee splashguard and the holes for receiving the polyurethane soft foam seat lining. This pottee chair is designed specifically for toilet training infants from 0-12 months. However, as the leg rest is no longer detachable it cannot be moved to accommodate infants of different sizes and leg length and hence, this pottee chair device will be molded such that it will accommodate infants of different sizes.

With reference to FIGS. 9A and 9B, in this embodiment the toilet seat (leg support platform 2) has a bend that divides the toilet seat into a proximal portion that is located proximal to where the toilet seat extends from the backrest and a distal portion that is located distal to where the toilet seat extends from the backrest. The toilet seat comprises an opening through which a user may urinate or defecate. The opening is located in the proximal portion of the toilet seat and lies on a first plane (in other words, the two-dimensional area that corresponds with the superior portion of the opening is located within the first plane). The distal portion has an upper surface that lies in a second plane. When the potty-training device of the present application is connected to a horizontal (flat) surface, the first plane extends at a positive angle with respect to the horizontal surface as measured from where the toilet seat extends from the backrest to the bend, and the second plane extends at a negative angle with respect to the horizontal surface as measured from the bend to a distal end of the distal portion.

Figure 1D:
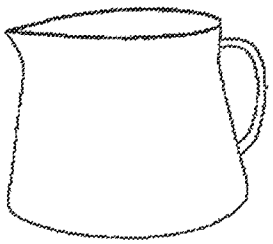
FIG. 1D is a perspective view of the plastic receiving pot which when used in conjunction with the pottee chair converts it to a portable, relocatable urination and defecation device for infants and toddlers.
Figure 1E:
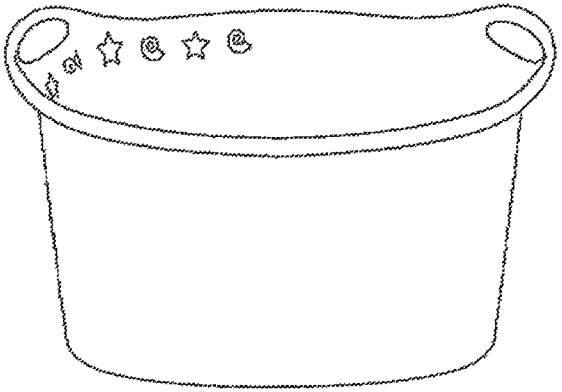
FIG. 1E shows the bathtub designed to be suitable for the infant pottee/bath chair to sit in when it is used as a bathing device.
Figure 1C:
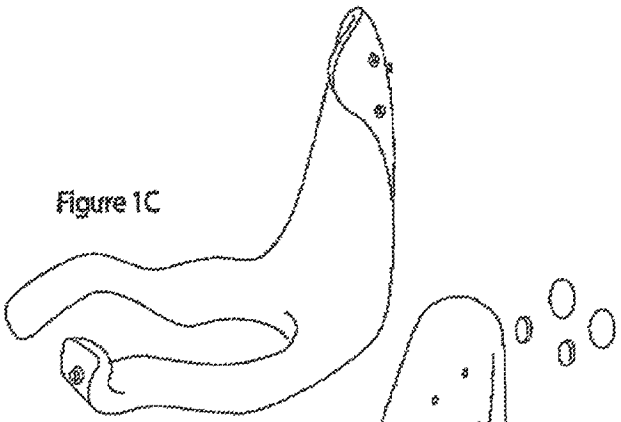
FIG. 1C is a perspective view of the self sealing horseshoe shaped polyurethane soft foam cushion which can be attached by rubber studs to the back rest and seat of the pottee chair, making it soft and comfortable for the seated infant or toddler.
Figure 1B:
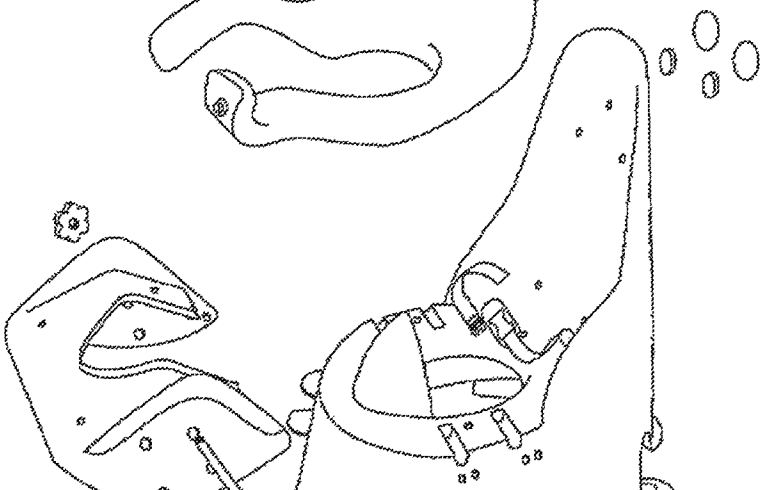
FIG. 1B is a perspective view of the attachable/detachable and adjustable leg rest which is used for raising the infant's legs whilst it is resting on the pottee chair. This enables the pottee chair to be used for toilet training young infants.
Figure 1A:
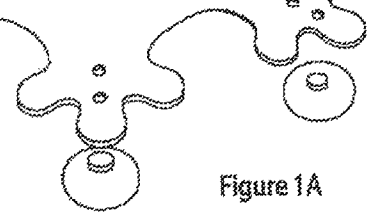
FIG. 1A is a perspective view of the basic toileting device, the pottee chair, for resting the infant's head and body or seating the toddlers, with their private parts over a pottee hole, while they are being toilet trained.
Figure 10A:
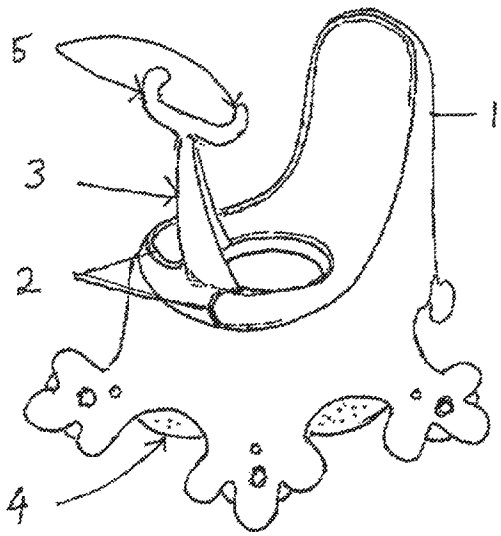
Figure 11:
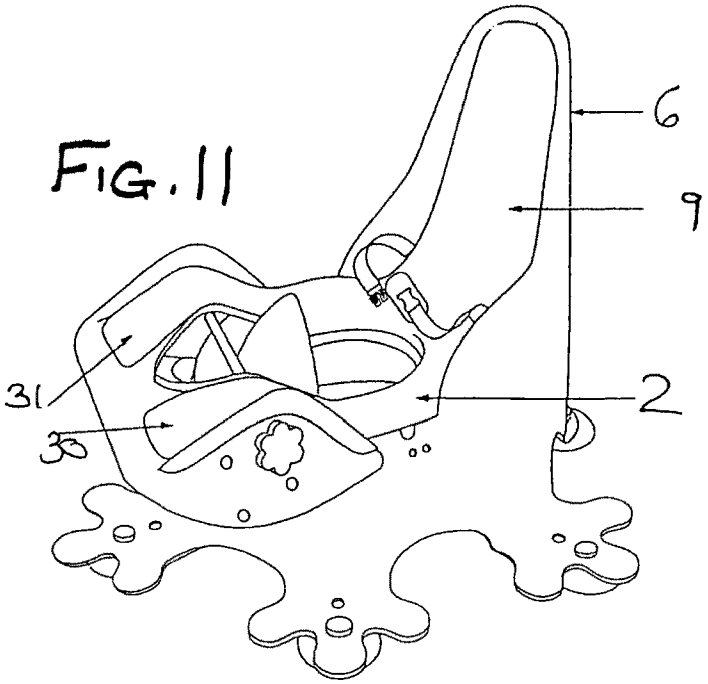
Figure 13:
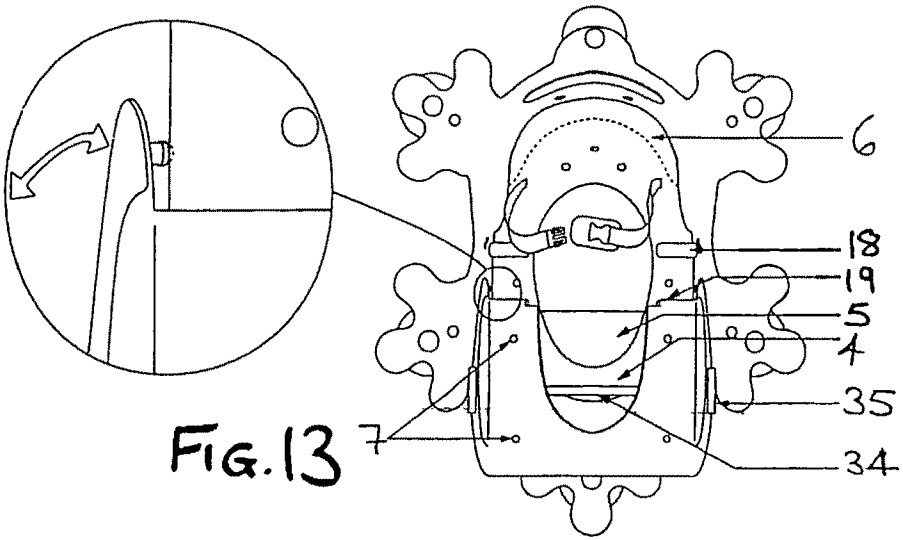
Figure 12:
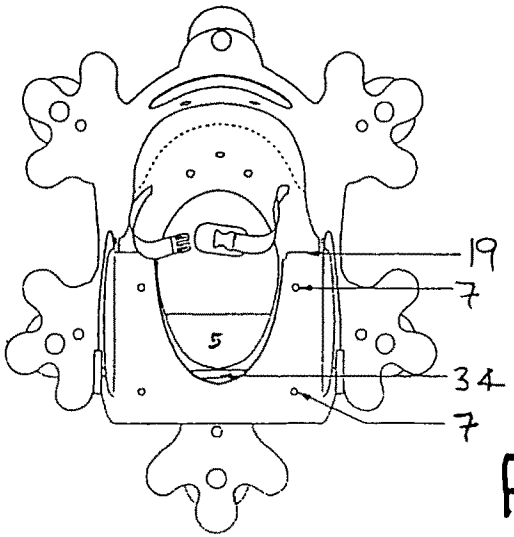
Figure 15:
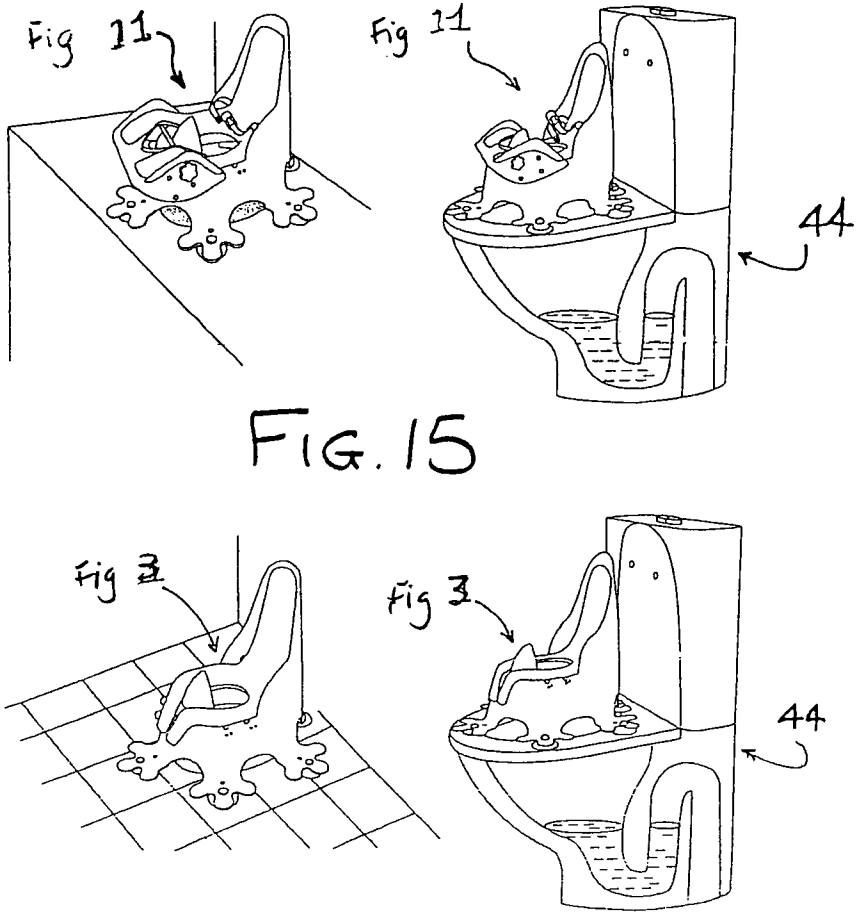
Figure 14:
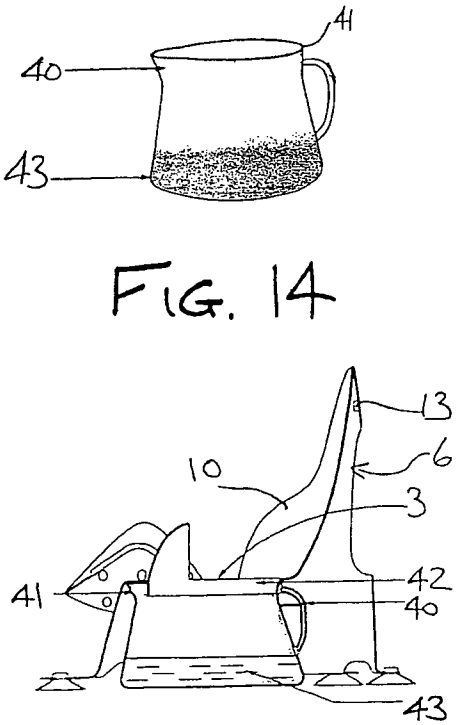
Figure 18:
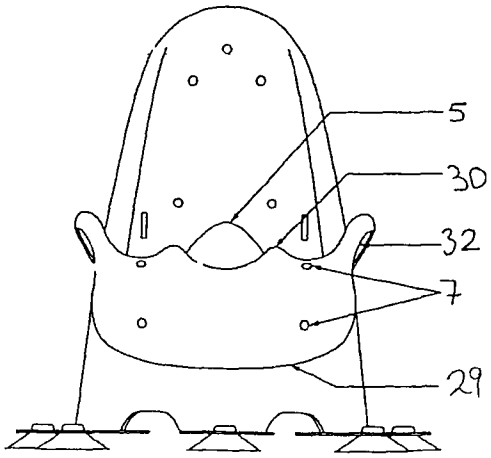
Figure 17:
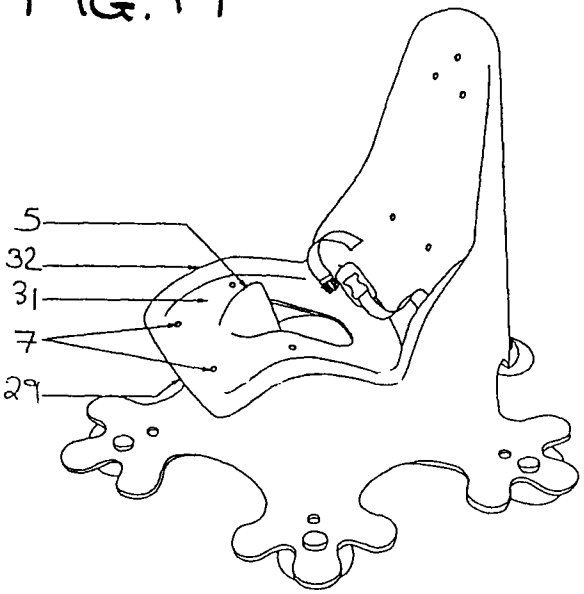

Page 10 Illustrations—Device 1 Version 4 of the Portable Pottee Chair Suitable for Toddlers/Preschoolers The infant pottee chair as in FIG. 1A can me made suitable for bigger toddlers and preschoolers. 1.5 to 2/3/4 yr olds who are toilet trained and can independently use the object This version has no leg rest, no music disc, no side guards, no seat belts and with a low backrest and a wee splashguard that has been extended into handle bars See FIG. 10A The pottee chair is made even more attractive to the toddlers/preschoolers if provided with a handle bar 10 A5, placed just behind and above the wee splash guard 10A 3, making it an object they can ride on while urinating or defecating. The handle bar also makes it easier for them to sit on and get up from the pottee chair as an structure they can use for support. The back rest 10A 1 is made lower and without a side guard as they do not require head and side support and the soft polyurethane foam seat retained but modified (see 10A 2) to provide them with a soft attractively padded toileting device. It can be used with a receiving pot (10A4). and placed in bathrooms so that it can be used independently by the toddler or preschooler. It would have at least six suction feet to provide a firm grip such that the structure remains immobile as the toddler gets up or sit down on it thus preventing the contents of the receiving pot from spilling. As they are already toilet trained no music disc will be necessary for this device which will be referred to as VERSION 4 of Device 1—the Toddler/Preschooler Pottee chair

The invention claimed is:

1. A toilet seat for assisting in toileting and toilet training infants, toddlers and young children, the toilet seat comprising:

a first recess and a second recess located on a right hand side of an opening of the toilet seat, wherein the first recess is located closer to a front end of the toilet seat than is the second recess;

a third recess and a fourth recess located on a left hand side of the opening, wherein the third recess is located closer to the front end of the toilet seat than is the fourth recess;

a left hand ramp portion disposed at a front left hand end of the toilet seat and extending above the toilet seat, wherein the left hand ramp portion contacts and raises the left hand thigh of a child towards their chest while the child is sitting on the toilet seat; and a right hand ramp portion disposed at a front right hand end of the toilet seat and extending above the toilet seat, wherein the right hand ramp portion contacts and raises the right hand thigh of the child towards their chest while the child is sitting on the toilet seat, wherein each of the right band ramp portion and the left hand ramp portion has a proximal end and a distal end, wherein the proximal end of the right hand ramp portion may he connected to either of the first recess or the second recess and the proximal end of the left hand ramp portion may he connected to either of the third recess or the fourth recess.

2. A toilet seat according to claim 1 wherein the ramp portions are integrally formed with a conventional toilet seat forming a closed loop or having an open front end.

3. A toilet seat according to claim 1 wherein the left and right hand ramp portions are removably mounted to a conventional toilet seat or to a toilet bowl.

4. A toilet seat according to claim 1 wherein the left and right hand ramp portions are adjustable between a raised position and a lowered position.

5. A toilet seat according to claim 1 wherein the left and right hand ramp portions are interconnected along a front edge.

6. A toilet seat according to claim 1, further comprising a head/back rest support.

7. A toilet including the toilet seat according to claim 1.

8. A toilet seat according to claim 1, further comprising a splash guard located along a front edge of the opening of the toilet seat, the splash guard extending above the opening.

9. A toilet seat according to claim 1, further comprising a sound-emitting device.

10. A potty-training device, the device comprising:

a body including a toilet seat, the toilet seat comprising an opening through which a user may urinate or defecate, the opening lying on a first plane;

a leg rest attached to the body and extending approximately from the opening towards a front side of the body, the leg rest comprising a first pair of surfaces and a second pair of surfaces, each of the surfaces of the first pair of surfaces being joined to a respective one of the surfaces of the second pair of surfaces by a bend, the leg rest being sized such that each of the first pair of surfaces is located beneath a respective thigh of the user and each of the second pair of surfaces is located beneath a respective shin of the user when the user is seated on the device with their buttocks located above the opening;

wherein each of the surfaces of the first pair of surfaces lies in a plane that extends at a positive angle with respect to the first plane as measured from where the leg rest is attached to the body to the respective bend;

wherein each of the surfaces of the second pair of surfaces lies in a plane that extends at a negative angle with respect to the first plane as measured from the respective bend to a distal end of the respective surface; and wherein an intersection of the first and second pairs of surfaces defines a maximum height above the toilet seat opening at, or adjacent to, a front of the toilet seat opening.

11. The device of claim 10, wherein the leg rest is adjustable between a raised position and a lowered position.

12. The device of claim 10, wherein the leg rest is integrally moulded with the body and toilet seat.

13. The device of claim 10, further comprising a splashguard located along a front edge of the opening, the front edge corresponding with the front side of the body, the splashguard extending at least partially above the first plane.

14. The device of claim 10, further comprising a pair of side guards that act to prevent movement of a user that is located on the device towards either a left side or a right side of the device.

15. The device of claim 10, further comprising a portable receptacle that is removably placeable beneath the opening.

16. The device of claim 10, wherein the body is releasably attachable to a toilet.

17. The device of claim 10, further comprising a sound-emitting device.

18. A toilet training device for a child having a chest, a left leg, a right leg, and a bottom, each of said right leg and said left leg having a thigh, a knee, and a calf, said toilet training device comprising:

a moulded plastic structure having a pair of elongate leg supports, a front wall, a rear wall, two side walls, a seat, and a backrest, said walls and said sides having a lower edge substantially defining a flat surface, said seat having a seat opening dimensioned to engage with said child's bottom, each of said elongate leg supports having a thigh support region, a knee support region and a calf support region, said knee support region being higher than, and intermediate, both of said thigh support region and said calf support region to thereby urge the knees of said child sitting on said device towards the chest of the child, each of said thigh support regions being upwardly inclined towards the corresponding knee support region, each of said calf support regions being downwardly inclined away from the corresponding knee support region and terminating at a front edge spaced above said flat surface, said seat opening being located between said pair of thigh supports, and both of said calf support regions and said knee support regions being located forwardly of said seat.

19. The toilet training device of claim 18, further comprising an upstanding urinary splash guard located between said knee supports.

20. The toilet training device of claim 18, wherein said two calf support regions are jointed together adjacent forward edges of said calf support region.

21. The toilet training device of claim 20, wherein each of said elongate leg supports has a side wing extending along an outside edge thereof, said side wings being adapted to restrain outward lateral movement of said legs of said child.

22. The toilet training device of claim 21, wherein said elongate leg supports are integrally moulded with said seat.

23. The toilet training device of claim 21, wherein said elongate leg supports are movable with respect to said seat.

24. The toilet training device of claim 18, further comprising a toilet seat ramp device for mounting the toilet training device to a toilet receptacle.

25. The toilet training device of claim 18, further comprising a potty.

26. The toilet training device of claim 18, wherein the toilet training device is supportable on a horizontal surface.

* * * * *